US011446691B2

(12) United States Patent
Wieser

(10) Patent No.: US 11,446,691 B2
(45) Date of Patent: Sep. 20, 2022

(54) SPRAY TANK BACKPACK APPARATUS

(71) Applicant: Michael Wieser, Brookville, IN (US)

(72) Inventor: Michael Wieser, Brookville, IN (US)

( * ) Notice: Subject to any disclaimer, the term of this patent is extended or adjusted under 35 U.S.C. 154(b) by 262 days.

(21) Appl. No.: 16/813,324

(22) Filed: Mar. 9, 2020

(65) Prior Publication Data

US 2021/0276029 A1 Sep. 9, 2021

(51) Int. Cl.
*B05B 9/08* (2006.01)

(52) U.S. Cl.
CPC ..... *B05B 9/0888* (2013.01)

(58) Field of Classification Search
CPC ... B05B 7/2475; B05B 7/1427; B05B 9/0888; A45F 3/08; A45F 3/10; A01M 7/0017; A01C 15/02; A62C 11/00
See application file for complete search history.

(56) References Cited

U.S. PATENT DOCUMENTS 2,083,039 A * 6/1937 Searls ..... F04B 33/00 239/153
3,269,129 A * 8/1966 Zambrano ..... B63C 11/30 224/633
3,563,431 A * 2/1971 Pletz ..... A45F 3/08 224/262
3,844,449 A * 10/1974 Alter ..... F41H 9/10 222/399
3,945,571 A * 3/1976 Rash ..... B05B 7/1418 239/152
5,299,767 A * 4/1994 Simpson ..... B05B 15/00 248/129
5,478,015 A * 12/1995 Black ..... B05B 9/0877 239/152
5,503,090 A * 4/1996 Guzan ..... A01B 1/00 222/548
5,636,791 A 6/1997 Leer
6,729,558 B1 * 5/2004 Seenauth ..... B05B 7/1427 239/152
7,021,508 B1 * 4/2006 Aston ..... A45F 3/10 224/628
7,140,449 B1 * 11/2006 Ebner ..... A62C 3/0207 239/289
7,175,104 B2 * 2/2007 Allen, IV ..... B05B 12/00 239/152
7,437,796 B2 * 10/2008 Rappin ..... B05B 7/2475 15/327.5
7,832,663 B1 * 11/2010 Cotham ..... A01C 15/02 239/152
8,066,206 B1 * 11/2011 Cotham ..... A01K 5/0225 239/152

(Continued)

*Primary Examiner* — Joseph A Greenlund

(57) ABSTRACT

A spray tank backpack apparatus for carrying spray tanks during use includes a frame having a frame left side, a frame right side, a frame top side, and a plurality of frame braces extending between the frame left side and the frame right side. A tank shelf is coupled to the frame and includes a shelf perimeter and a plurality of shelf braces. The shelf perimeter is coupled adjacent a bottom end of each of the frame left side and the frame right side. The plurality of shelf braces supports an industrial pressurized tank. A pair of hose brackets is coupled to the frame and is configured to receive a hose of the industrial pressurized tank. A pair of shoulder straps is coupled to the frame to be worn like a backpack.

9 Claims, 6 Drawing Sheets

(56) References Cited

U.S. PATENT DOCUMENTS 8,561,866 B2 * 10/2013 Gleason, Jr. ..... A45F 3/08 224/637
D699,940 S 2/2014 Robert
9,079,200 B2 * 7/2015 Fornaro ..... B05B 9/085
2002/0088829 A1 * 7/2002 Hsu ..... A45C 9/00 224/155
2006/0091235 A1 * 5/2006 Langhans ..... B05B 7/1422 239/152
2008/0257928 A1 * 10/2008 Lowry ..... A45F 3/10 224/638
2008/0277301 A1 * 11/2008 Gill ..... B65D 85/20 206/446
2009/0145978 A1 * 6/2009 Reynolds ..... B05B 7/2475 239/152
2009/0269124 A1 * 10/2009 Raddick ..... A47L 13/26 401/268
2011/0272487 A1 * 11/2011 Reynolds ..... B05B 7/2475 239/152
2014/0209646 A1 * 7/2014 Hoppa ..... A45F 3/08 224/261
2014/0209705 A1 * 7/2014 Bahr ..... B05B 7/1418 239/152
2016/0037895 A1 * 2/2016 Humphreys ..... A45F 3/10 224/633
2017/0106385 A1 * 4/2017 Schrum ..... B05B 9/0888
2017/0311703 A1 * 11/2017 Wistrand ..... A45F 5/10
2018/0021800 A1 * 1/2018 Janik ..... B05B 15/62 239/146
2018/0072335 A1 * 3/2018 Goodwin ..... B62B 3/104
2018/0117372 A1 * 5/2018 Mesman ..... A62B 9/04
2019/0030554 A1 * 1/2019 Mantes ..... B05B 9/0888
2021/0046494 A1 * 2/2021 Lam ..... H02J 7/0044
2021/0078026 A1 * 3/2021 Suardika ..... B05B 9/0861
2021/0274859 A1 * 9/2021 Saggio ..... A45F 3/14
2021/0276029 A1 * 9/2021 Wieser ..... B05B 9/0805

* cited by examiner

SPRAY TANK BACKPACK APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to spray tank devices and more particularly pertains to a new spray tank device for carrying spray tanks during use.

(2) Description of Related Art including information disclosed under 37 CFR 1.97 and 1.98.

The prior art relates to spray tank devices and particularly devices that having carrying straps. Existing backpack style devices typically have integrated tanks and hand pumps to create pressure. Such devices cannot receive industrial pressurized tanks and also do not have a storage solution for extra hose length.

BRIEF SUMMARY OF THE INVENTION

An embodiment of the disclosure meets the needs presented above by generally comprising a frame having a frame left side, a frame right side, a frame top side, and a plurality of frame braces extending between the frame left side and the frame right side. A tank shelf is coupled to the frame and includes a shelf perimeter and a plurality of shelf braces. The shelf perimeter is coupled adjacent a bottom end of each of the frame left side and the frame right side. The plurality of shelf braces is configured to support an industrial pressurized tank. A pair of hose brackets is coupled to the frame and is configured to receive a hose of the industrial pressurized tank. A pair of shoulder straps is coupled to the frame and configured to be worn like a backpack.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
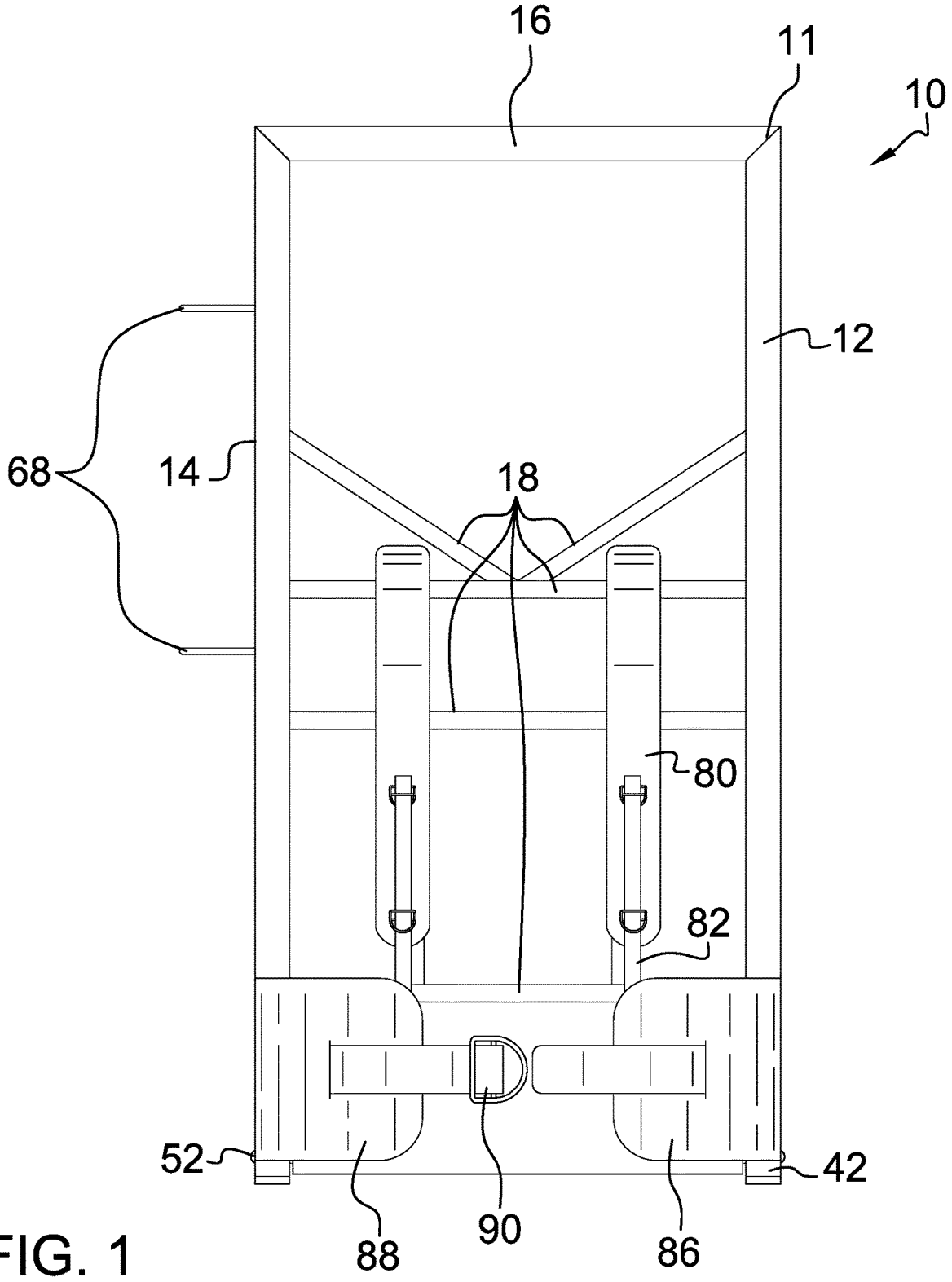
FIG. 1 is a front elevation view of a spray tank backpack apparatus according to an embodiment of the disclosure.
Figure 2:
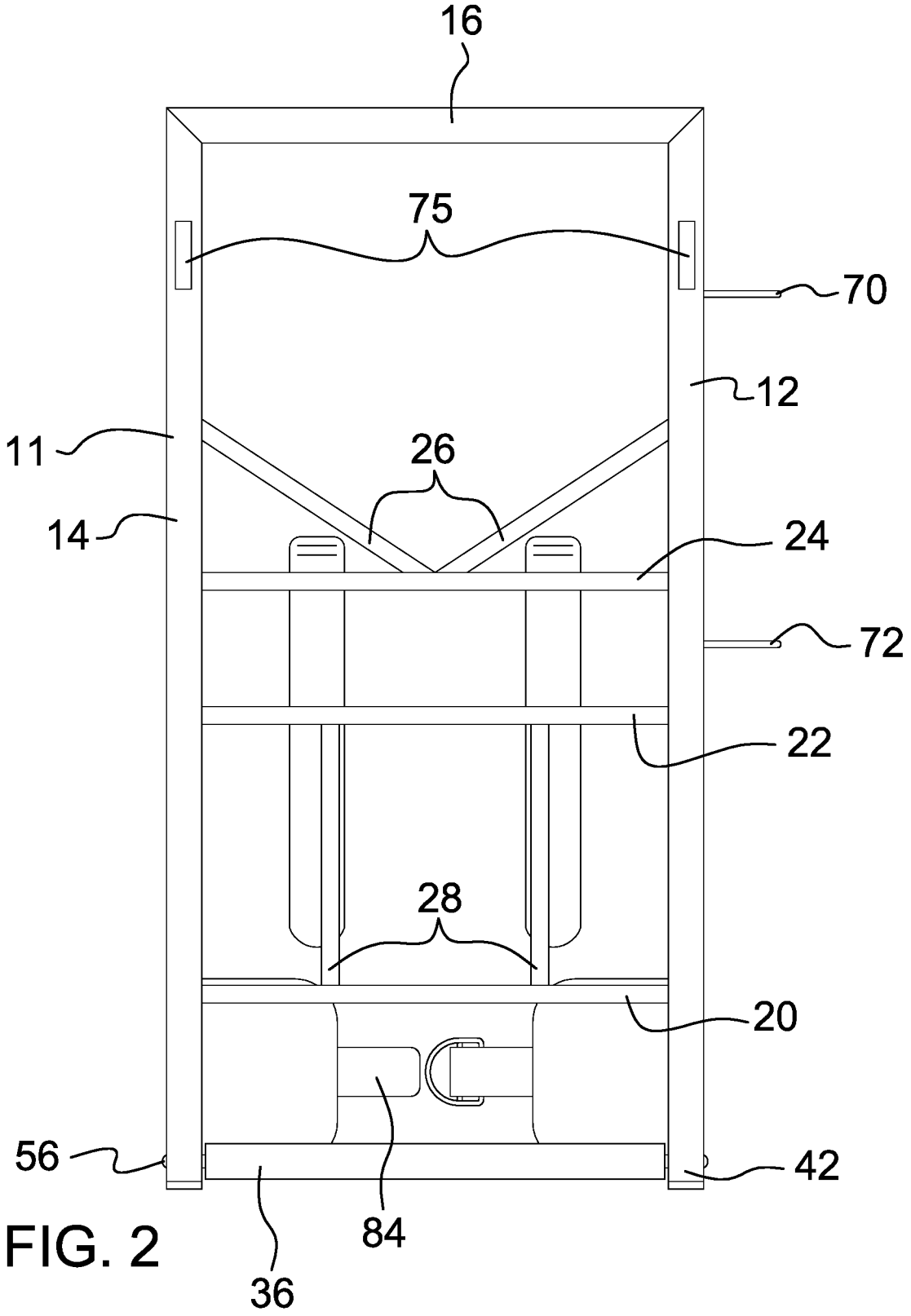
FIG. 2 is a rear elevation view of an embodiment of the disclosure.
Figure 3:
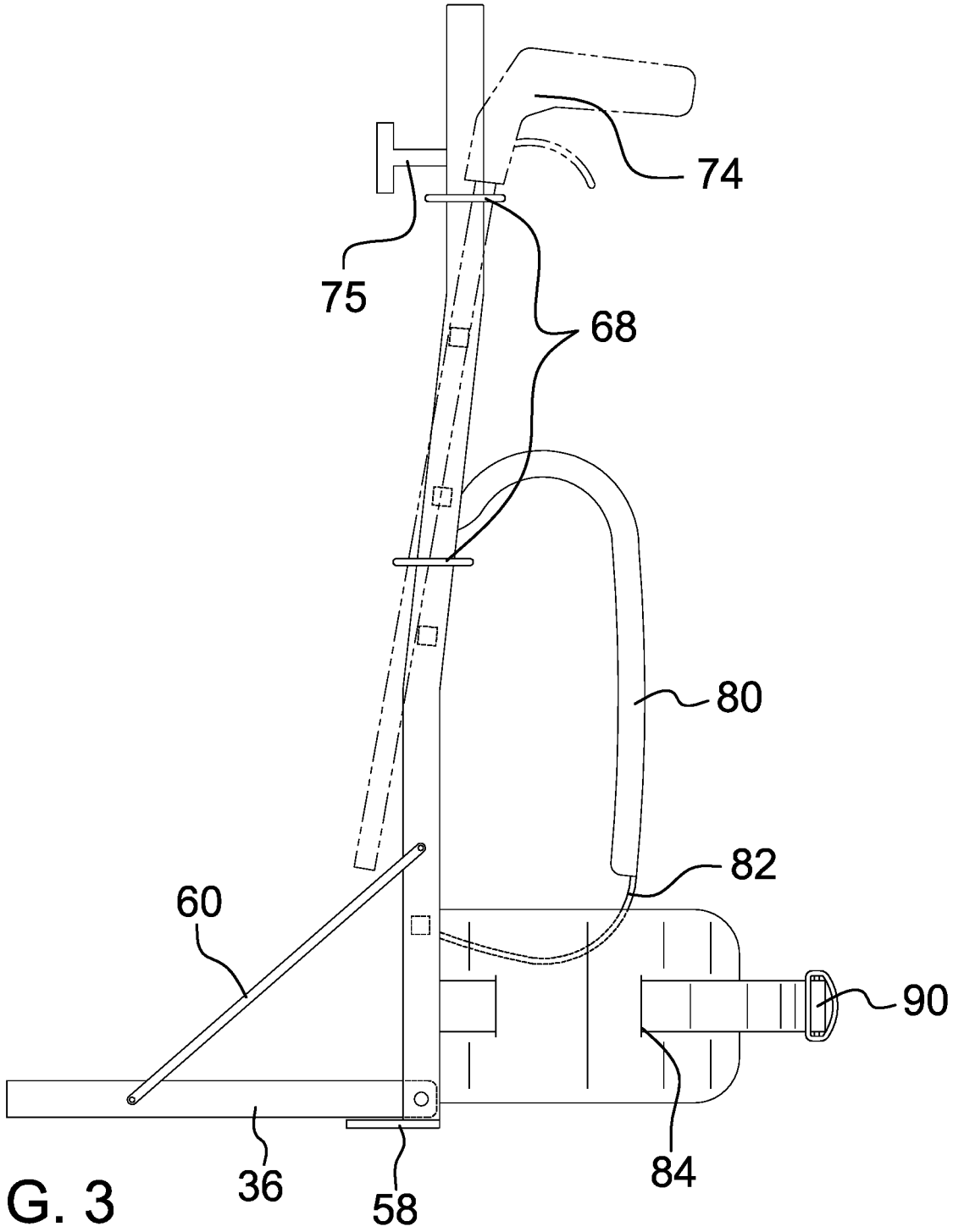
FIG. 3 is a side elevation view of an embodiment of the disclosure.
Figure 4:
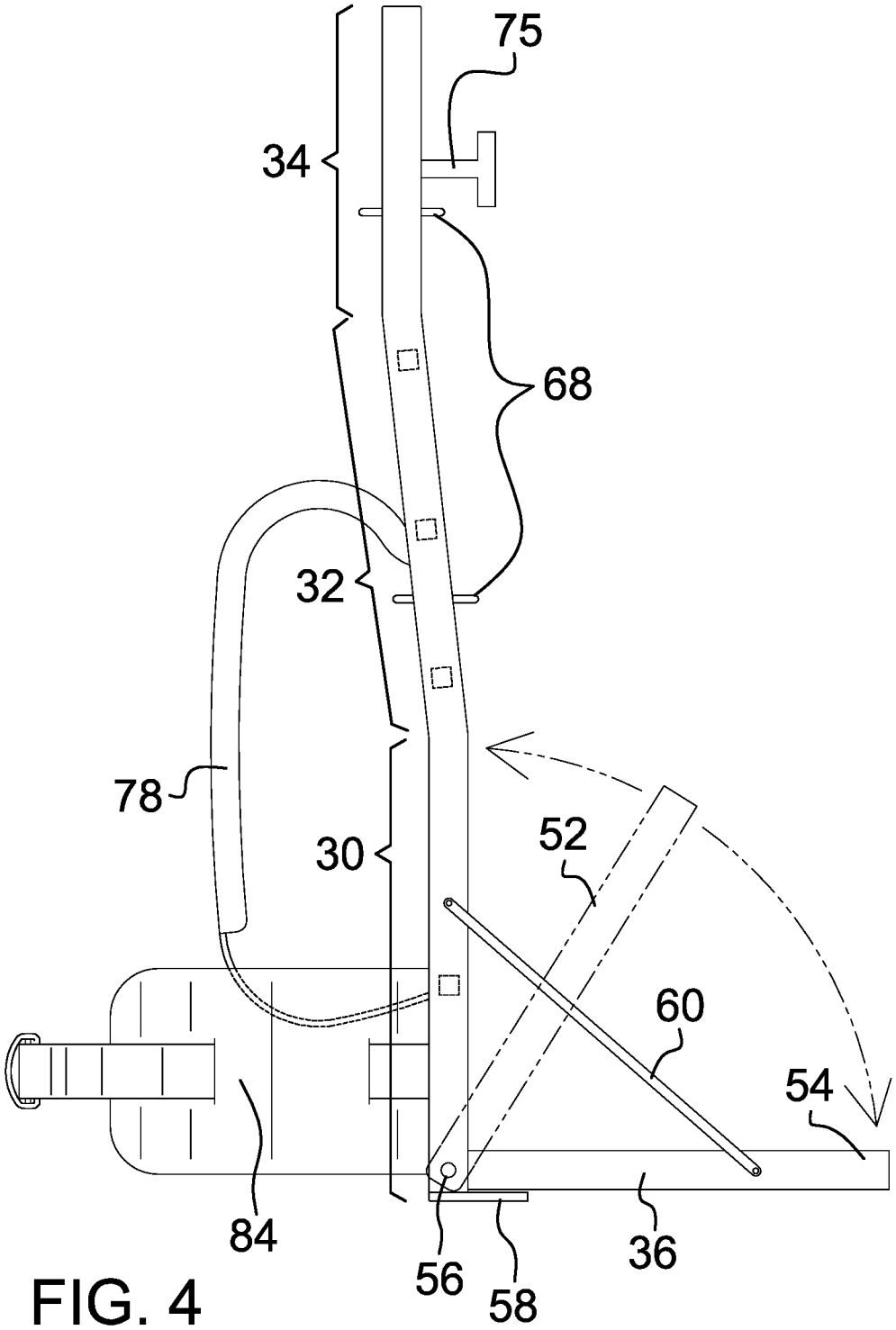
FIG. 4 is a side elevation view of an embodiment of the disclosure.
Figure 5:
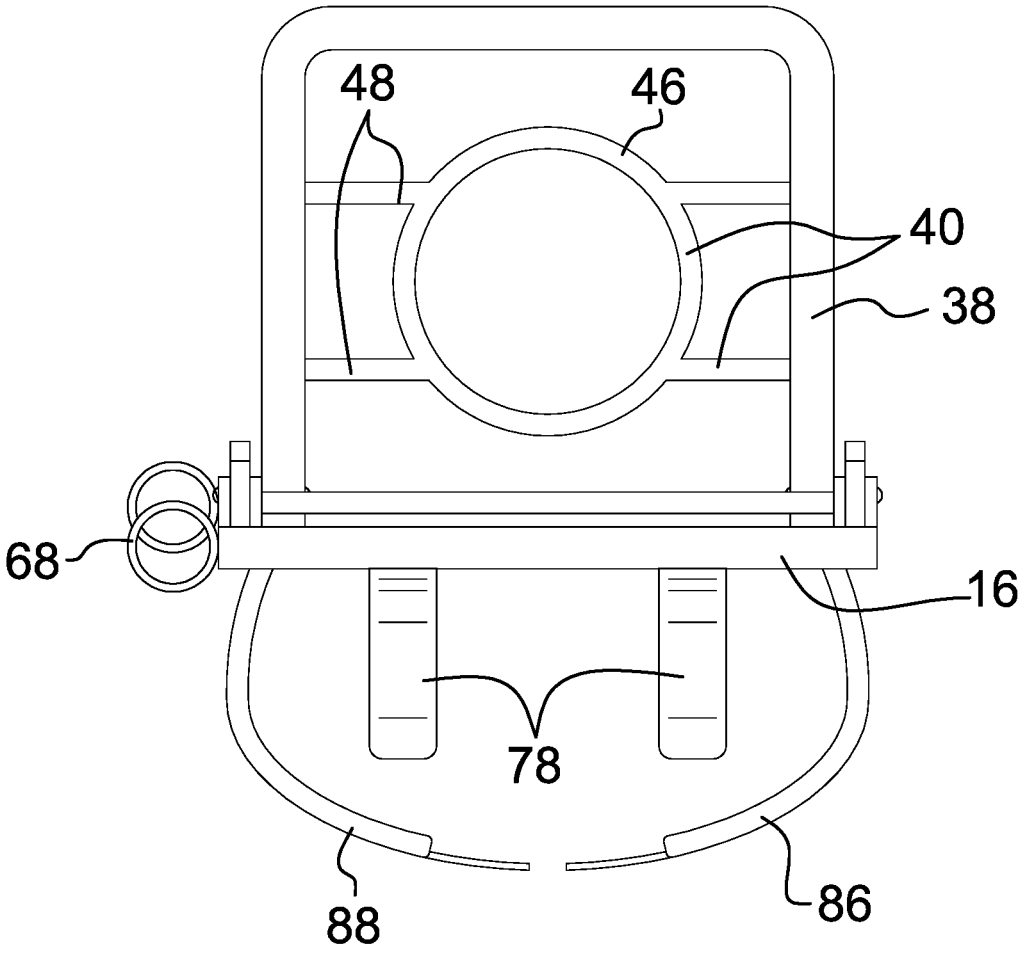
FIG. 5 is a top plan view of an embodiment of the disclosure.
Figure 6:
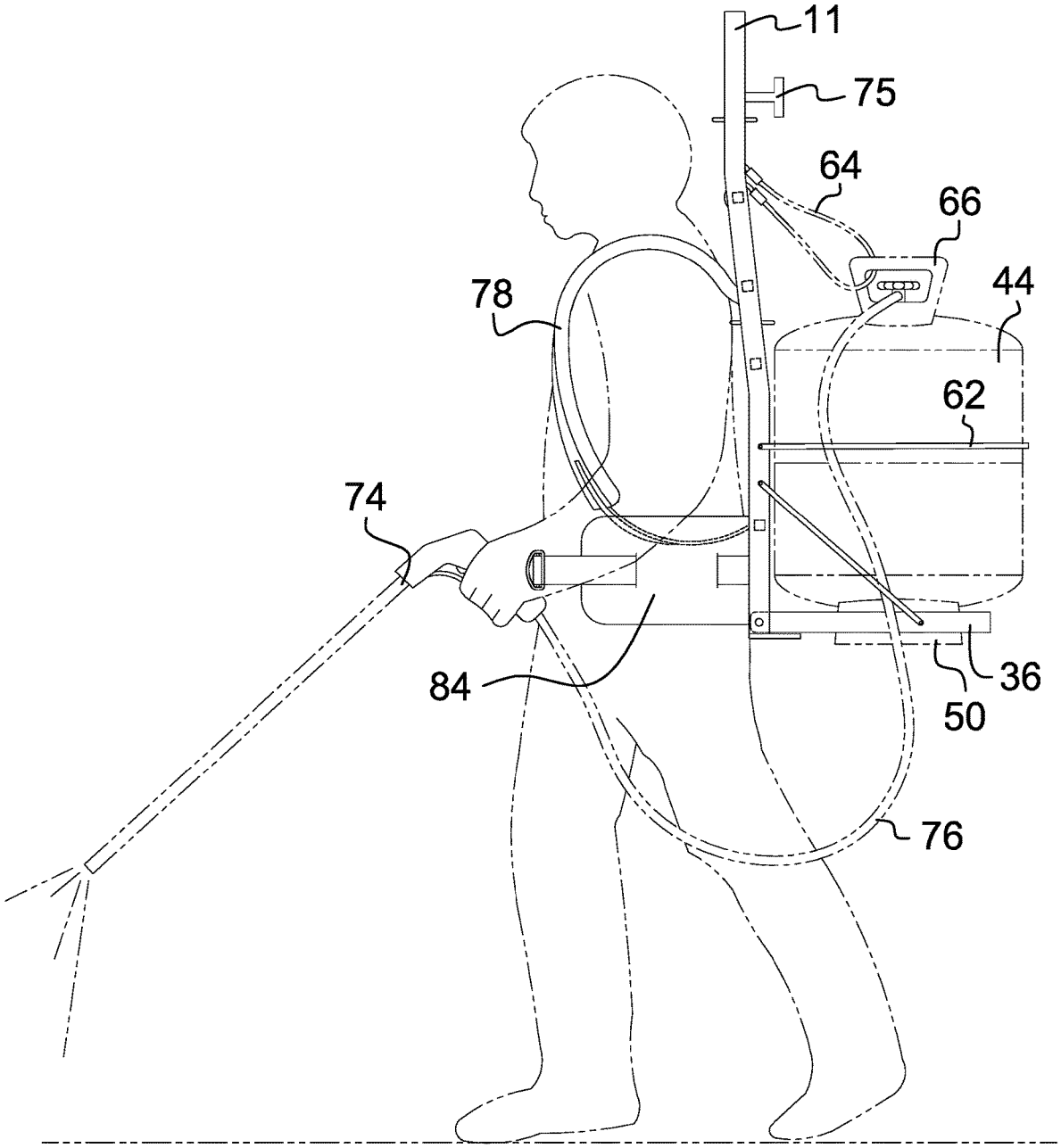
FIG. 6 is an in-use view of an embodiment of the disclosure.

With reference now to the drawings, and in particular to FIGS. 1 through 6 thereof, a new spray tank device embodying the principles and concepts of an embodiment of the disclosure and generally designated by the reference numeral 10 will be described.

As best illustrated in FIGS. 1 through 6, the spray tank backpack apparatus 10 generally comprises a frame 11 having a frame left side 12, a frame right side 14, a frame top side 16, and a plurality of frame braces 18 extending between the frame left side 12 and the frame right side 14. The plurality of frame braces 18 may comprise a lower horizontal frame brace 20, a medial horizontal frame brace 22, an upper horizontal frame brace 24, and a pair of angled frame braces 26 medially extending from the upper horizontal frame brace 24 to the frame left side 12 and the frame right side 14. There may be a pair of parallel vertical frame braces 28 extending between the lower horizontal frame brace 20 and the medial horizontal frame brace 22. Each of the frame left side 12 and the frame right side 14 may have a lower vertical portion 30, a medial angled portion 32, and an upper vertical portion 34 to create a more ergonomic fit on a user's back.

A tank shelf 36 is coupled to the frame 11. The tank shelf 36 includes a shelf perimeter 38 and a plurality of shelf braces 40. The shelf perimeter 38 may be pivotably coupled adjacent a bottom end 42 of each of the frame left side 12 and the frame right side 14. The plurality of shelf braces 40 is configured to support an industrial pressurized tank 44 holding pressurized content for a plurality of applications including, but not limited to, painting, gardening, roofing, and the like. The plurality of shelf braces 40 may include a central tank ring 46 and a plurality of support arms 48 extending form the central tank ring 46 to the shelf perimeter 38. The central tank ring 46 is configured to receive a tank base 50 of the industrial pressurized tank 44 and thus is dimensioned according to standard sizes of the industrial pressurized tank 44. The plurality of support arms 48 may be two pairs of parallel support arms 48.

The tank shelf 36 pivots between a store position 52 adjacent the frame 11 and a support position 54 extending perpendicularly from the frame 11. As the industrial pressurized tank 44 can be very heavy, a pivot rod 56 coupled to the shelf perimeter 38 may not provide sufficient support. A shelf support lip 58 may also be coupled to the bottom end 42 of each of the frame left side 12 and the frame right side 14 to support the tank shelf 36 in the support position 54. A pair of shelf support straps 60 may also be coupled to the frame 11 and the tank shelf 36 for additional reinforcement. The pair of shelf support straps 60 extends from the frame left side 12 and the frame right side 14 to the shelf perimeter 38 and are dimensioned to be taut when the tank shelf 36 is in the support position 54.

A tank support strap 62 may be coupled to the frame 11 to secure the industrial pressurized tank 44 to the apparatus 10. The tank support strap 62 is coupled to the frame left side 12 and the frame right side 14 and may be elasticized or otherwise adjustable to create a secure fit around the industrial pressurized tank 44. A safety lanyard 64 may also be coupled to the frame 11 to prevent the industrial pressurize tank 44 from falling should the tank support strap 62 fail. The safety lanyard 64 is coupled to the plurality of frame braces 18 and is configured to loop through a tank handle 66 of the industrial pressurized tank.

A wand holder 68 is coupled to the frame 11 and may comprise an upper wand ring 70 and a lower wand ring 72 each coupled to the frame right side 14. The wand holder 68 is configured to receive a spray wand 74 of the industrial pressurized tank for storage. The upper wand ring 70 is coupled to the upper vertical portion 34 and the lower wand ring 72 is coupled to the medial angled portion 32 to create an offset. A pair of hose brackets 75 is coupled to the frame 11 and configured to receive a hose 76 of the industrial pressurized tank. Each of the pair of hose brackets 74 may be T-shaped for the hose 76 to be wrapped around multiple times and allowing the hose 76 to be longer.

A pair of shoulder straps 78 is coupled to the frame 11 and is configured to be worn like a backpack. Each shoulder strap 78 may have a padded portion 80 and an adjustment portion 82. A waist belt 84 may be coupled to the frame 11 for further support and user comfort. The waist belt 84 includes a left belt portion 86 and a right belt portion 88 coupled to the frame left side 12 and the frame right side 14, respectively, and a belt fastener 90 to adjustably and selectively engage the left belt portion 86 and the right belt portion 88.

In use, the industrial pressurized tank 44 is placed on the tank shelf 36 and secured with the tank support strap 62 and the safety lanyard 64. The shoulder straps 78 and the waist belt 84 are then worn by the user to carry the apparatus 10 and conveniently operate the spray wand 74 without worrying about the inconveniences and dangers posed by the hose 76 that arise when the industrial pressurized tank 44 is on the ground.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A spray tank backpack apparatus comprising:

a frame having a frame left side, a frame right side, a frame top side, and a plurality of frame braces extending between the frame left side and the frame right side;

a tank shelf coupled to the frame, the tank shelf including a shelf perimeter and a plurality of shelf braces, the shelf perimeter being coupled adjacent a bottom end of each of the frame left side and the frame right side, the plurality of shelf braces being configured to support a pressurized tank, the plurality of shelf braces including a central tank ring and a plurality of support arms extending form the central tank ring to the shelf perimeter, the central tank ring being configured to receive a tank base of the pressurized tank;

a pair of hose brackets coupled to the frame, the pair of hose brackets being configured to receive a hose of the pressurized tank, each of the pair of hose brackets being T-shaped;

a pair of shoulder straps coupled to the frame, the pair of shoulder straps being configured to be worn like a backpack; and a safety lanyard coupled to the frame, the safety lanyard being coupled to the plurality of frame braces and being configured to loop through a tank handle of the pressurized tank.

2. The spray tank backpack apparatus of claim 1 further comprising the shelf perimeter being pivotably coupled to the frame; a shelf support lip coupled to the frame, the shelf support lip being coupled to the bottom end of each of the frame left side and the frame right side.

3. The spray tank backpack apparatus of claim 2 further comprising a pair of shelf support straps being coupled to the frame and the tank shelf, the pair of shelf support straps extending from the frame left side and the frame right side to the shelf perimeter.

4. The spray tank backpack apparatus of claim 1 thither comprising the plurality of support arms being two pairs of parallel support arms.

5. The spray tank backpack apparatus of claim 1 further comprising a tank support strap coupled to the frame, the tank support strap being coupled to the frame left side and the frame right side and configured to secure the pressurized tank.

6. The spray tank backpack apparatus of claim 1 further comprising a wand holder coupled to the frame, the wand holder comprising an upper wand ring and a lower wand ring coupled to the frame right side, the wand holder being configured to receive a spray wand of the pressurized tank.

7. The spray tank backpack apparatus of claim 1 further comprising each of the frame left side and the frame right side having a lower vertical portion, a medial angled portion, and an upper vertical portion.

8. The spray tank backpack apparatus of claim 1 further comprising a waist belt coupled to the frame, the waist belt including a left belt portion and a right belt portion coupled to the frame left side and the frame right side, respectively, and a belt fastener to adjustably and selectively engage the left belt portion and the right belt portion.

9. A spray tank backpack apparatus comprising:

a frame having a frame left side, a frame right side, a frame top side, and a plurality of frame braces extending between the frame left side and the frame right side, each of the frame left side and the frame right side having a lower vertical portion, a medial angled portion, and an upper vertical portion;

a tank shelf coupled to the frame, the tank shelf including a shelf perimeter and a plurality of shelf braces, the shelf perimeter being pivotably coupled adjacent a bottom end of each of the frame left side and the frame right side, the plurality of shelf braces being configured to support a pressurized tank, the plurality of shelf braces including a central tank ring and a plurality of support arms extending form the central tank ring to the shelf perimeter, the central tank ring being configured to receive a tank base of the pressurized tank, the plurality of support arms being two pairs of parallel support arms;

a shelf support lip coupled to the frame, the shelf support lip being coupled to the bottom end of each of the frame left side and the frame right side;

a pair of shelf support straps being coupled to the frame and the tank shelf, the pair of shelf support straps extending from the frame left side and the frame right side to the shelf perimeter;

a tank support strap coupled to the frame, the tank support strap being coupled to the frame left side and the frame right side and configured to secure the pressurized tank;

a safety lanyard coupled to the frame, the safety lanyard being coupled to the plurality of frame braces and being configured to loop through a tank handle of the pressurized tank;

a wand holder coupled to the frame, the wand holder comprising an upper wand ring and a lower wand ring coupled to the frame right side, the wand holder being configured to receive a spray wand of the pressurized tank;

a pair of hose brackets coupled to the frame, each of the pair of hose brackets being T-shaped, the pair of hose brackets being configured to receive a hose of the pressurized tank;

a pair of shoulder straps coupled to the frame, the pair of shoulder straps being configured to be worn like a backpack; and a waist belt coupled to the frame, the waist belt including a left belt portion and a right belt portion coupled to the frame left side and the frame right side, respectively, and a belt fastener to adjustably and selectively engage the left belt portion and the right belt portion.

* * * * *